US005822642A

United States Patent [19]

Ichita

[11] Patent Number: 5,822,642

[45] Date of Patent: Oct. 13, 1998

[54] DEVELOPING AND PACKAGING METHOD FOR PHOTOGRAPHIC FILM AND APPARATUS FOR THE SAME

[76] Inventor: Akemi Ichita, 5-3-22-318 Tsuji, Urawa-shi, Saitama, Japan

[21] Appl. No.: 841,104

[22] Filed: Apr. 30, 1997

[30] Foreign Application Priority Data

May 9, 1996 [JP] Japan ..... 8-115136

[51] Int. Cl.[6] ..... G03D 3/08

[52] U.S. Cl. ..... 396/613; 398/615; 398/567; 355/27; 355/75

[58] Field of Search ..... 396/612, 613, 396/615, 567; 355/72, 75, 77, 27; 430/434

[56] References Cited

U.S. PATENT DOCUMENTS

| | | | |
|---|---|---|---|
| 4,860,037 | 8/1989 | Harvey | 396/512 |
| 5,122,820 | 6/1992 | Pagano et al. | 396/512 |
| 5,296,887 | 3/1994 | Zander | 396/512 |
| 5,432,580 | 7/1995 | Tokuda | 396/570 |
| 5,447,827 | 9/1995 | Ishikawa et al. | 430/434 |

*Primary Examiner*—D. Rutledge
*Attorney, Agent, or Firm*—Young & Thompson

[57] ABSTRACT

When an IX240-type photographic film is brought in a photofinishing laboratory, a user selects a winding form or a cutting form. At the laboratory, selected form is inputted with a keyboard and a controller controls a film transport changing unit due to the selected form. When the winding form is selected, the developed photographic film is transported to a film winding unit. When the cutting form is selected, the developed photographic is transported to a cutter. The film winding unit winds the photographic film into the cartridge so as to contain it as a long film. The cutter cuts the photographic film every predetermined number of frames to make plural film pieces. The film pieces are contained in a film sheath.

12 Claims, 7 Drawing Sheets

DEVELOPING AND PACKAGING METHOD FOR PHOTOGRAPHIC FILM AND APPARATUS FOR THE SAME

BACKGROUND OF THE INVENTION

1. Field of the Invention

The present invention relates to a packaging method for a photographic film and more particularly to a packaging method for developed photographic film and a packaging apparatus for the same.

2. Description of the Related Art

Recently, a new standard photographic film called IX240 cartridge film is on sale. As disclosed in U.S. Pat. Nos. 4860037, 5122820 and 5296887, the IX240 cartridge film has various features in comparison with conventional 135-type photographic film. The first feature is that all of the photographic film is wound in a cartridge made of plastic. Top end of the photographic film, namely film leader, is advanced to the outside of the cartridge by rotating a spool. Due to the first feature, it becomes easy to load the photographic film into a camera and intricate mechanism for advancing the top end of the photographic film is not required.

Second feature is that transparent magnetic layer is applied on a back face of the photographic film. For example, photographic information and printing information with respect to each photographic frame may be recorded by a magnetic head at a side portion of the photographic film corresponding to each frame. The photographic information of each frame is read out before printing and utilized for printing so that good-quality printed photographs may be obtained.

Third feature is that developed photographic film is returned in a state wherein the photographic film is wound in the cartridge again as a long film. Due to this feature, it becomes easy to advance the photographic film in an image input device. The image input device is connected to a television for home use or a personal computer to display an image of desired photographic frame on the television or to introduce it into the personal computer.

As to the IX240 cartridge film, developed photographic film is contained in the cartridge. The developed photographic film is returned with an index of printed photographs on which images of all frames are printed in reduced-size and arranged in matrix. Accordingly, picture frames of the photographic film may be readily recognized.

However, if the index of printed photographs is lost, images of the photographic film contained in the cartridge are not recognized anymore. At this time, a person having an image input device, for example a scanner, can recognize the photographic images by displaying them on the monitor. But, a person who does not have the image input device can not recognize the photographic image of the photographic film contained in the cartridge.

As to a low-priced camera using the IX240-type photographic film and a single-use camera in which the photographic film is preloaded, a magnetic head is not built therein so that magnetic data of photographic information and the like are not recorded on the photographic film. Few users using the low-priced camera or the single-use camera have the image input device. Accordingly, for such users, there are few advantages when the developed photographic film is returned in a state wherein the photographic film is contained in the cartridge. There arises, rather, a problem in that a paper sack for returning is bulky due to the cartridge so that it is difficult to keep it in custody.

SUMMARY OF THE INVENTION

In view of the foregoing problems, it is a primary object of the present invention to provide a packaging method for a developed photographic film in which the developed photographic film is returned in an optimum form for the user.

It is a second object of the present invention to provide a packaging method for a developed photographic film in which the form is selected due to request of the user.

It is a third object of the present invention to provide a packaging method for a developed photographic film in which the form is automatically selected.

In order to active the above and other objects, the packaging method for the developed photographic film according to the present invention comprises the step of selecting a package form. In the present invention, there are two package forms, one of which is a cutting form and the other of which is a winding form. When the cutting form is selected, the developed photographic film is cut into a plurality of film pieces by a cutter and the film pieces are contained in a sheet-like film sheath. When the winding form is selected, the developed photographic film is wound into a cartridge by a film winding unit so as to contain it as a long film.

In a preferred embodiment, the package form is selected due to a request of the user. At a photofinishing laboratory, the selected package form is introduced in a controller via a keyboard. The controller transports the developed photographic film to the cutter or the film winding unit according to the selected package form.

In an other embodiment, the package form is automatically selected due to whether photographic information is recorded in a magnetic layer provided on the photographic film. When the photographic information is not recorded, the cutting form is selected. When the photographic information is recorded, the winding form is selected.

In an another embodiment, the package form is automatically selected due to whether the photographic film is exposed with a single-use camera or not. When the photographic film is exposed with the single-use camera, the cutting form is selected. When the photographic film is not exposed with the single-use camera, the winding form is selected.

When the photographic film is a reversal film, the reversal film is cut every each picture frame in the cutting form. The each picture frame is attached to a mount.

According to the present invention, the user can select the package form. If the user selects the cutting form, the user can readily confirm picture frames of the developed photographic film because it is not contained in the cartridge. Further, this form is suitable for keeping the developed photographing film in custody because it is thin. If the user selects the winding form, there is not any fear of cutting magnetic data recorded in the photographic film.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

In a small-scale photofinishing laboratory, there are prepared a detaching unit, a film processor, an index printer and a printer processor in order to perform a developing process and a printing process for IX240-type photographic film, for example, negative film.

When an exposed negative film is drawn out of a cartridge, the detaching unit is used. In the detaching unit, an intermediate cartridge is set. The exposed negative film drawn out of the cartridge is wound into the intermediate cartridge from a top portion thereof. As to the intermediate cartridge, an end portion of the film comes out of the intermediate cartridge by a little amount. The intermediate cartridge is set on the film processor in a state wherein a leader sheet is stuck on the end portion of the film. The film processor is provided with a sprocket transport mechanism to advance the negative film into a developing trough via the leader sheet. For the negative film advanced to the developing trough, processes of developing, fixing, washing by water and drying are performed, and after that the negative film is discharged. Incidentally, although the negative film is wound on a core attached in the intermediate cartridge from a top portion thereof, the top portion is adapted to be separated from the core by pulling it.

Figure 2:
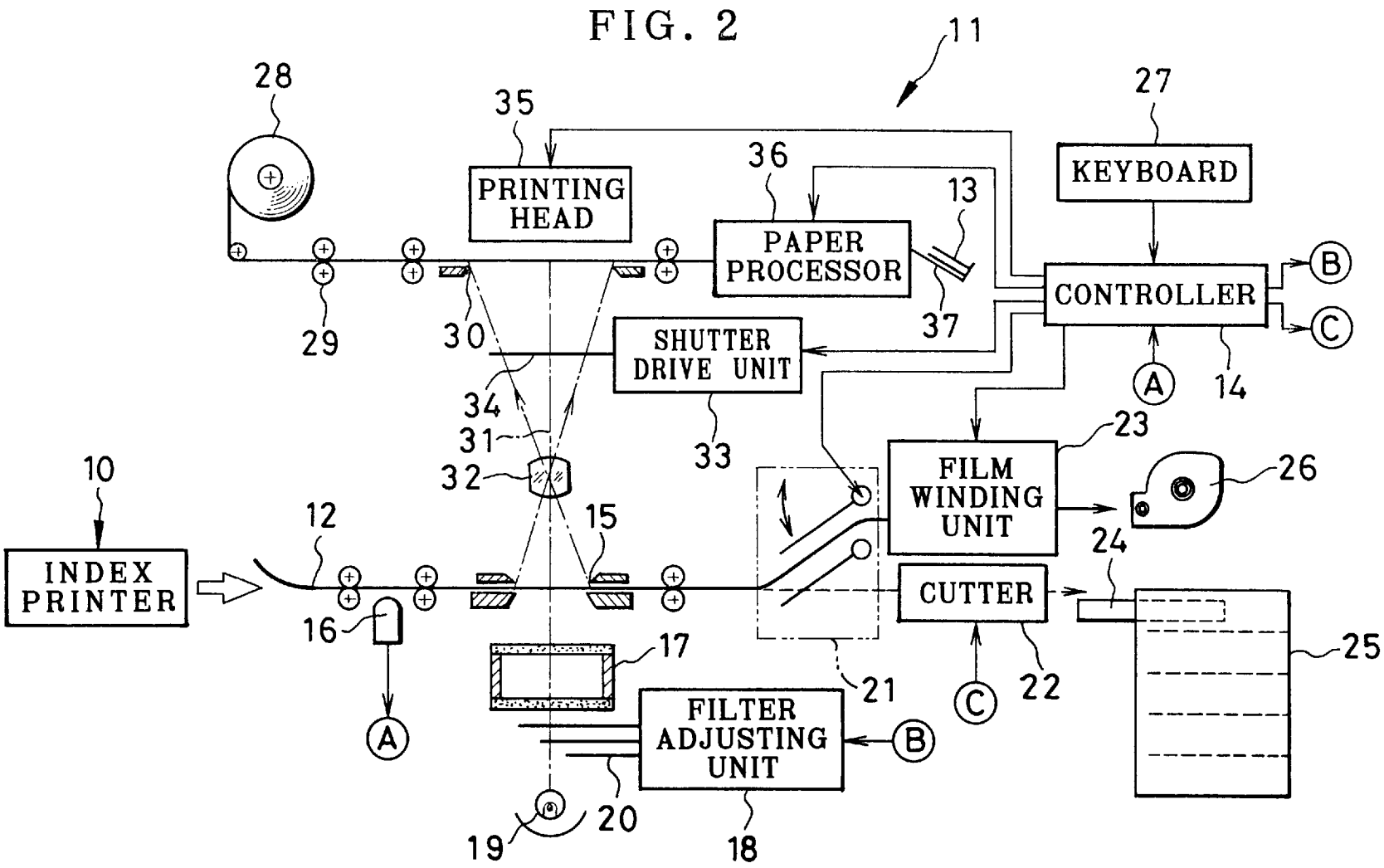
FIG. 2 is an explanatory view illustrating summary of a printer processor.

As shown in FIG. 2, developed negative film 12 is set in an index printer 10. In the index printer, image data of three color relative to each frame of the negative film are read out. The image data are reduced and wrote in a frame memory in matrix based on a predetermined format in order to be composed. After the image data of all frames are read out, the composed image data are displayed, for example, on a CRT or a liquid crystal display. The displayed images are printed on a color paper in one-photoprint size to make an index of the photoprint.

A printer processor 11 makes a photoprint 13 on the basis of the developed negative film 12. Mechanical units of the printer processor 11 are totally controlled by a controller 14. The controller 14 advances each frame of the negative film 12 to printing position 15 in order. Just before the printing position 15, a reproducing magnetic head 16 is provided. The controller 14 reads out photographic information which is relative to each picture frames of the negative film, for example a date of photographing and a title, during one-frame advancement via the reproducing magnetic head 16. The photographic information is recorded at a position corresponding to each frame on the negative film as magnetic data.

Under the printing position 15, there are disposed a diffusion box 17, a filter adjusting unit 18 and a white-light source 19. White light radiated from the white-light source 19 passes through the diffusion box 17 and illuminates each frame set at the printing position 15 from the back side thereof, in other words, from the side of an opposite face with respect to emulsion face. The filter adjusting unit 18 regulates an inserting amount of a color filters 20 to a printing optical path 31 when the white-light source 19 emits the light so that the illuminating light is adjusted according to the image of each frame. The color filter 20 is constituted of a cyan filter, a magenta filter and an yellow filter in case of color negative film.

At the downstream side of the printing position 15, a film transport changing unit 21 is provided. The film transport changing unit 21 transports the negative film 12 to one of a cutter 22 and a film winding unit 23 by changing a film transport path. The cutter 22 is attached to a negative inserting unit which is well known. The inserting unit is controlled by the controller 14 and cuts the negative film 12 every predetermined number of frames to make a plurality of film pieces. The film pieces 24 corresponding to one film are contained in a sheet-like film sheath 25 by the inserting unit. In the film winding unit 23, a cartridge 26 remained in the film processor is set. The negative film 12 is wound in the cartridge 26 without cutting. This winding operation is performed such that film end portion engages with a spool and the spool is rotated in film winding direction. By the way, the cartridge for containing the developed negative film as a long film may not be the cartridge brought by the user. Moreover, the film winding unit 23 and the inserting unit may be separated from the printer processor 11. At this time, the negative film is set in one of the film winding unit 23 and the inserting unit by manual operation.

A keyboard 27 is connected to the controller 14. A package form of the developed film is inputted in the controller 14 via the keyboard 27 according to a designation of the user. There are two package forms. The first package form is cutting form in which the film is cut every predetermined number of frames to make the film pieces 24. The film pieces 24 corresponding to one film are contained in the film sheath 25. The second package form is winding form in which the film is wound in the brought cartridge 26 without cutting as a long film. The controller 14 controls the film transport changing unit 21 so as to transport the negative film 12 to the cutter 22 in case of the cutting form and to the film winding unit 23 in case of the winding form. Further, the controller 14 actuates the cutter 22 or the film winding unit 23 on the basis of the package form to process the negative film 12 as requested by the user.

A color paper 28 is set around a winding shaft as a roll and transported to an exposure stage 30 by a take-up roller pair 29. The printing position 15 is opposed to the exposure stage 30 and a printing lens 32 is disposed at the optical path 31 between the printing position 15 and the exposure stage 30. A shutter 34 controlled by a shutter drive unit 33 is provided between the printing lens 32 and the exposure stage 30.

The exposure stage 30 is provided with a character printing head 35. The character printing head 35 is driven by the controller 14 and prints the photographic information with characters on a rear face of the color paper 28 every each frame during one-frame advancement of the color paper 28. The one-frame advancement of the color paper is performed after printing exposure is over.

The exposed color paper 28 is transported to a paper processor 36. In the paper processor 36, the color paper 28 passes through each of processing troughs to perform photographic process and is cut every each frame at the last. The cut color paper is discharged to a tray 37 as the photoprint 13.

Figure 3:
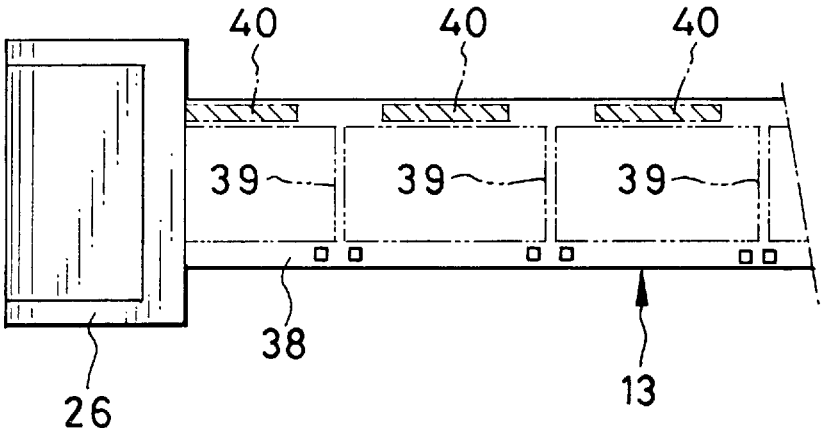
FIG. 3 is a top view illustrating IX240-type photographic film as viewed from rear side thereof.

With respect to the negative film 12, transparent magnetic layer is applied on the opposite face of the emulsion face. As shown in FIG. 3, the photographic information is recorded at a predetermined recording area 40 every each frame 39 by a magnetic head disposed in a camera.

Figure 1:
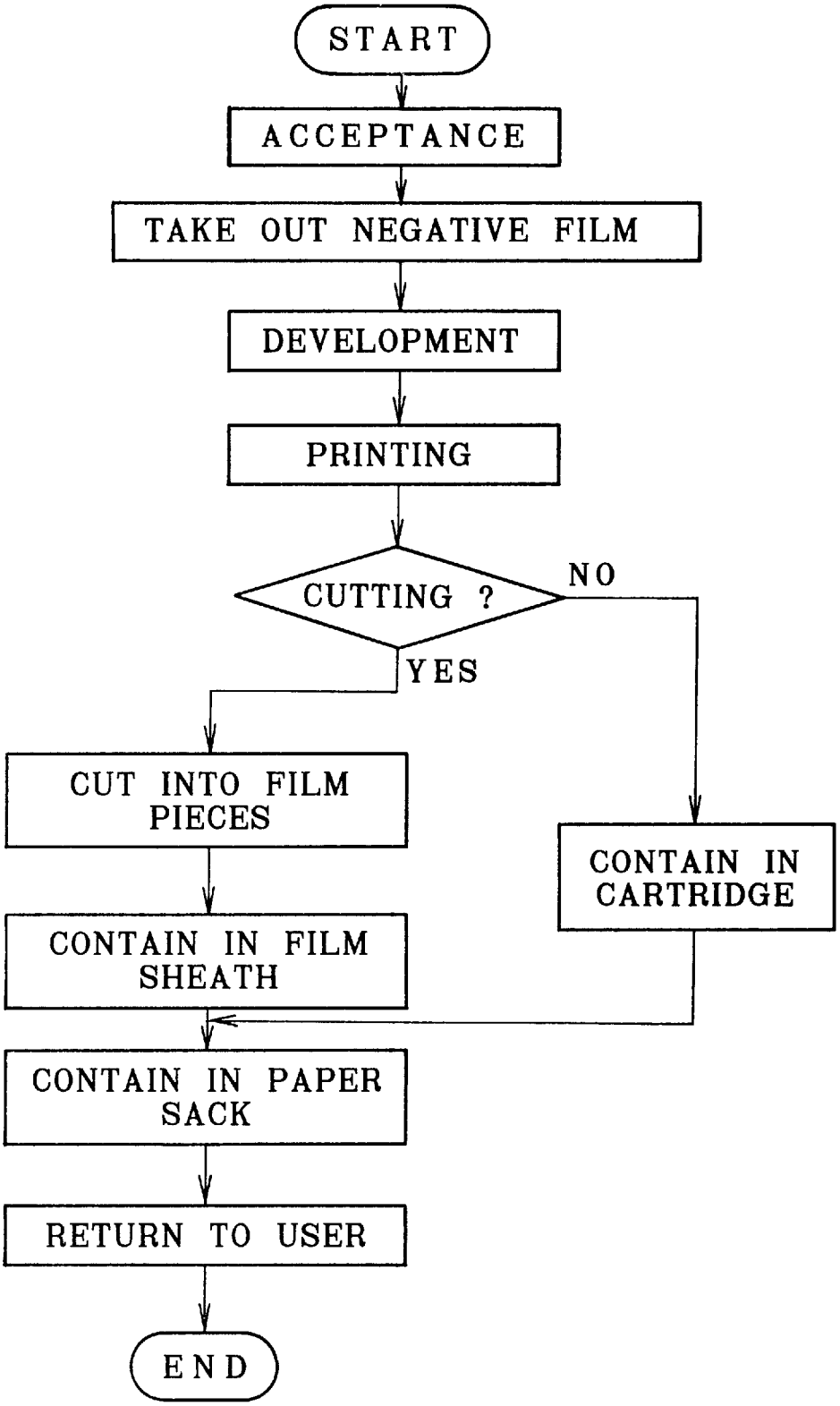
FIG. 1 is a flowchart showing a sequence for changing package form of a developed photographic film due to a request of a user.

Referring to FIG. 1, an operation of the foregoing construction is described. The user brings a cartridge containing the exposed negative film to the photofinishing laboratory wherein the exposed negative film is accepted for developing and printing. At this time, the user selects one of the package forms and requests the winding form or the cutting form.

The accepted cartridge is set in the detaching unit and the exposed negative film is transported into the intermittent cartridge. The intermittent cartridge is set in the film processor. The exposed negative film is drawn out of the set intermittent cartridge to perform the developing process. The developed negative film 12 is set in the index printer 10 to make an index of photoprints.

After that, the negative film 12 is set in the printer processor 11. At this time, an operator inputs the package form wrote on a paper sack for returning with keyboard 27. If the winding form is inputted with the keyboard 27, the winding form is introduced to the controller 14. Thus, the controller 14 changes the film transport changing unit 21 to a state shown in FIG. 2. After that, the negative film 12 is transported to the printing position 15 and first exposed frame is set at the printing position 15. During the transportation, the controller 14 reads out the photographic information corresponding to the first exposed frame via the reproducing magnetic head 16.

After the exposed frame is set at the printing position, the controller 14 controls the filter adjusting unit 18 to regulate the light. After that, the controller 14 controls the shutter drive unit 33 to open the shutter 34 by predetermined time so that printing is performed. Thus, the image of each frame of the negative film 12 is printed on the color paper 28 set at the exposed position by the printing lens 32. When the printing of the negative image is completed, the color paper 28 is advanced by one frame. During the advancement, characters of the date of photographing, title and so on corresponding to the photographic information are printed on the back face of the color paper 28 by driving the character printing head 35.

Above-described operation is repeated. The color paper 28 on which predetermined number of frames are printed is transported to the paper processor 36. In the paper processor 36, the color paper 28 passes through each processing trough to perform photographic processes and is cut every one frame by cutter. The cut color paper is discharged to the tray 37 as photoprint 13.

When the printing process is completed, the negative film 12 is transported to the film winding unit 23 by the film transport changing unit 21. In the film winding unit 23, the brought cartridge 26 is set. The film winding unit 23 engages the end edge of the negative film 12 with the spool of the cartridge 26. After that, the spool is rotated in film winding direction to contain the negative film 12 in the cartridge 26 as a long film. The cartridge 26 containing the negative film 12 is put in the paper sack with photoprints and index of the photoprints, and returned to the user.

On the other hand, in case of the cutting form, the controller 14 changes the film transport changing unit 21 to transport the negative film 12 to the cutter 22 of the inserting unit. The cutter 22 cuts the negative film 12 every predetermined number of frames to make a plurality of film peaces 24. The film pieces 12 corresponding to one photographic film are contained in the film sheath 25. The film sheath 25 is put in the paper sack and returned to the user with the photoprints and the index of photoprint. Incidentally, at this time, the cartridge is collected in a factory as it is and recycled after containing a new non-exposed photographic film.

When the negative film is cut, the photographic information recorded in the negative film may be printed on a sheet or an index sheet. The sheet or the index sheet is given to the user. The photographic information is recorded on the recording area 40 in format of magnetic signal. The recording area 40 is arranged at a side of the photographic film 13 and allocated for each frame. The photographic information regards to, for example, a date of photographing, a place of photographing, shutter speed, a value of stop, an exposure factor and an electronic flash.

Figure 4:
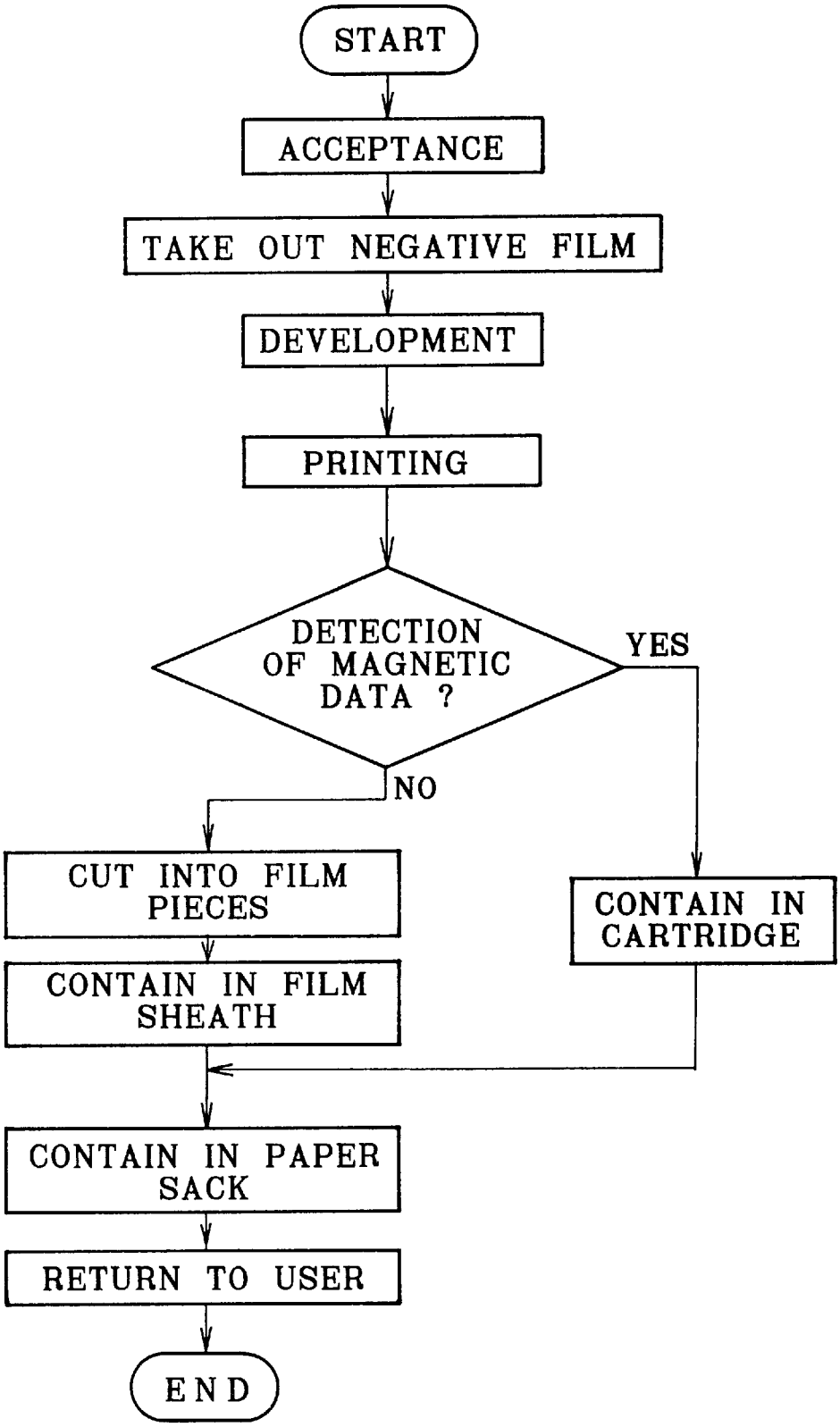
FIG. 4 is a flowchart showing a sequence of another embodiment in which the package form of the developed photographic film is changed due to magnetic data.

In the above-described embodiment, the package form is changed according to request of the user. However, as shown in FIG. 4, the package form may be changed according to whether the photographic information is magnetically recorded in the negative film or not. In other words, the negative film 12 is returned in a winding form when the photographic information is recorded in the negative film, and returned in a cutting form when the photographic information is not recorded. In this case, labor of inputting the package form with keyboard may be omitted. Further, as the negative film recording the photographic information is returned in the winding form, it is prevented that the photographic information can not be read out due to cutting of the negative film.

Figure 6:
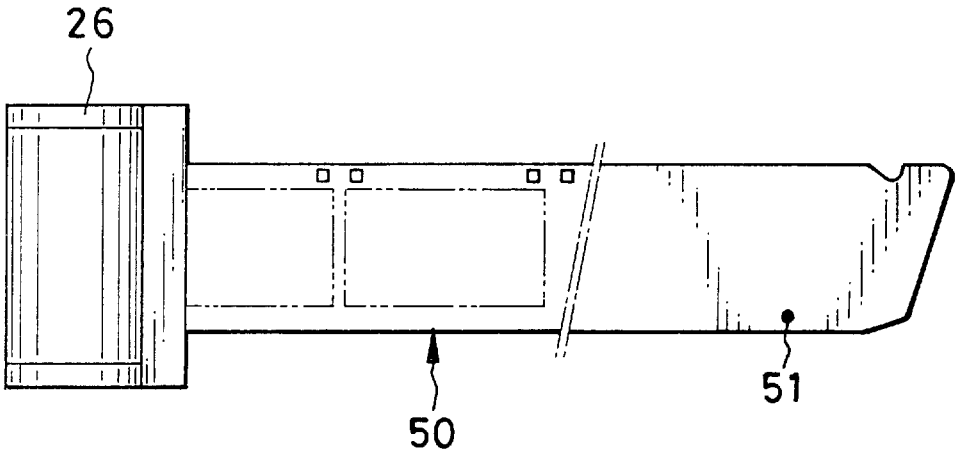
FIG. 6 is a top view of a photographic film provided with a mark which is disposed at top end thereof and indicates that photographs are taken by the single use camera, as viewed from a side of emulsion.
Figure 5:
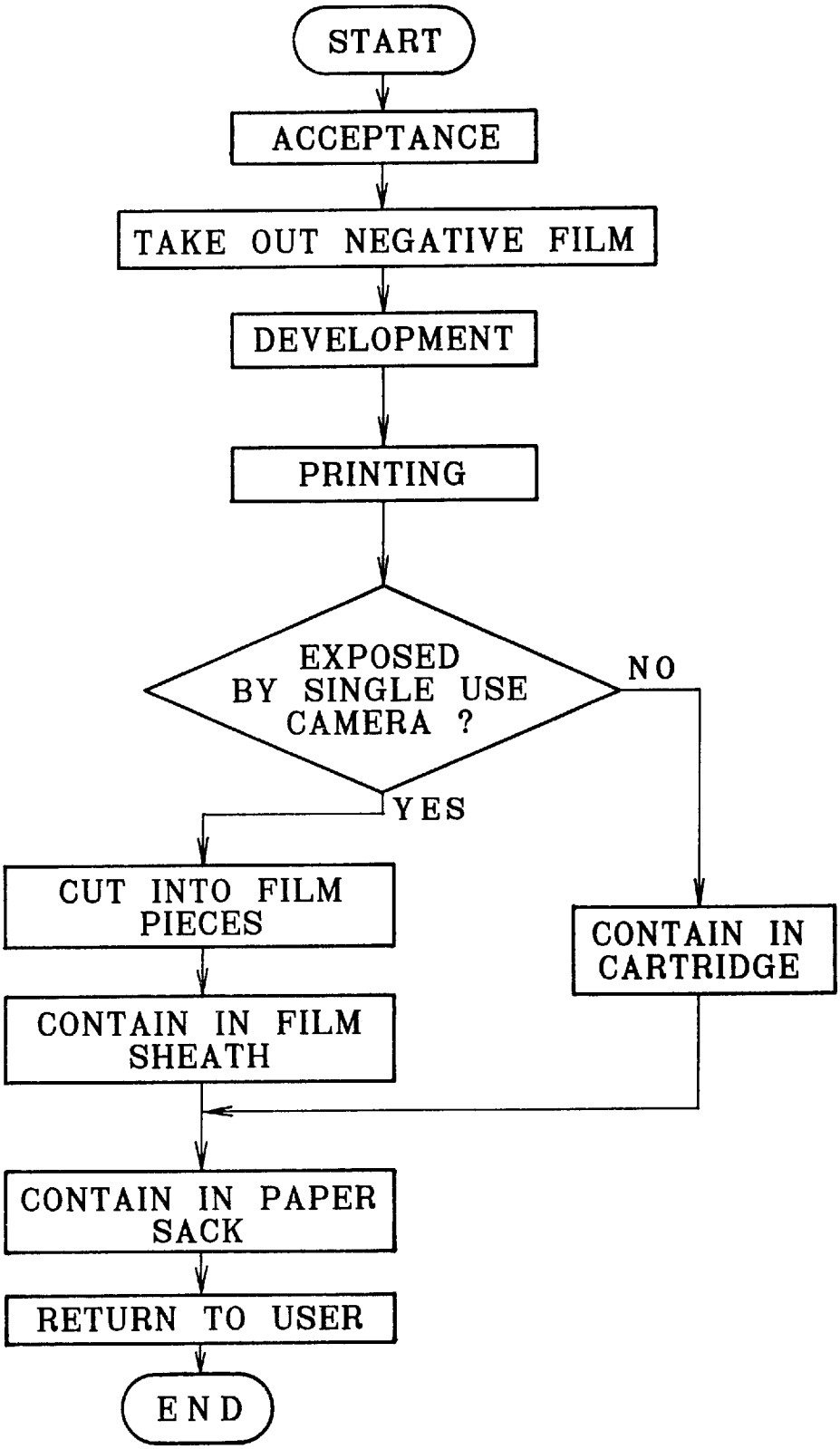
FIG. 5 is a flowchart showing a sequence of another embodiment in which the package form is changed due to whether photographs are taken by a single use camera or not.

A single use camera in which a photographic film is preloaded at a factory is on sale. In the negative film 12 exposed by such a singe use camera, the photographic information is not recorded. Thus, as shown in FIG. 5, when the negative film is exposed by the single use camera, the negative film is returned in the cutting form. In other case, namely, when the negative film is exposed by an ordinary camera, the negative film is returned in the winding form. In these case, a mark 51, which is shown in FIG. 6 for example, is provided beforehand on a non-exposed photographic film 50 in order to detect whether the photo film is exposed by a single use camera or not. In other words, the mark 51 represents whether the photographic film is exposed by the single use camera or not.

It is preferable to provide the mark by means of optical record, magnetic record or perforating besides the mark shown in FIG. 6. In case of optical record, the mark is recorded on an emulsion-face side. In case of magnetic record, the mark is recorded on a back-face side which is magnetic layer side. A detector for detecting the mark is disposed next to the reproducing magnetic head shown in FIG. 2 and detects the mark at first of film advancement. In case of optical record, for example, a scanner or photo sensor is preferable as the detector. In case of magnetic record, the existent reproducing magnetic head may be used as the detector.

The mark may be recorded on the cartridge 26. In this case, it is preferable to provide the mark on a label attached to an outer surface of the cartridge 26. An operator confirms the mark and inputs it with the keyboard 27. As the mark attached to the cartridge, a bar code may be utilized. The bar code records data relative to a manufacture number, film sensitivity, exposed frame number and so on. Further, data indicating that the negative film is for the single use camera may be added to the bar code. In this case, the bar code is read out by a bar code sensor when the cartridge is set in the film processor. The data regarding to whether the negative film is exposed by the single use camera or not is automatically inputted to the controller 14 of the printer processor 11.

The foregoing embodiments are described with respect to the small-scale photofinishing laboratory; however, it is needless to say that they are applied to a large-scale photofinishing laboratory. In the large-scale photofinishing laboratory, a plurality of exposed negative films drawn out from the cartridge are connected by a slice tape or the like and developed continuously as successive negative films. After development, the successive negative films are set to the printer processor in roll-like form. In the printer processor, the successive negative films are drawn out and printed successively. After printing, the negative films are separated each other and transported to the inserting unit or the film winding unit.

Figure 7:
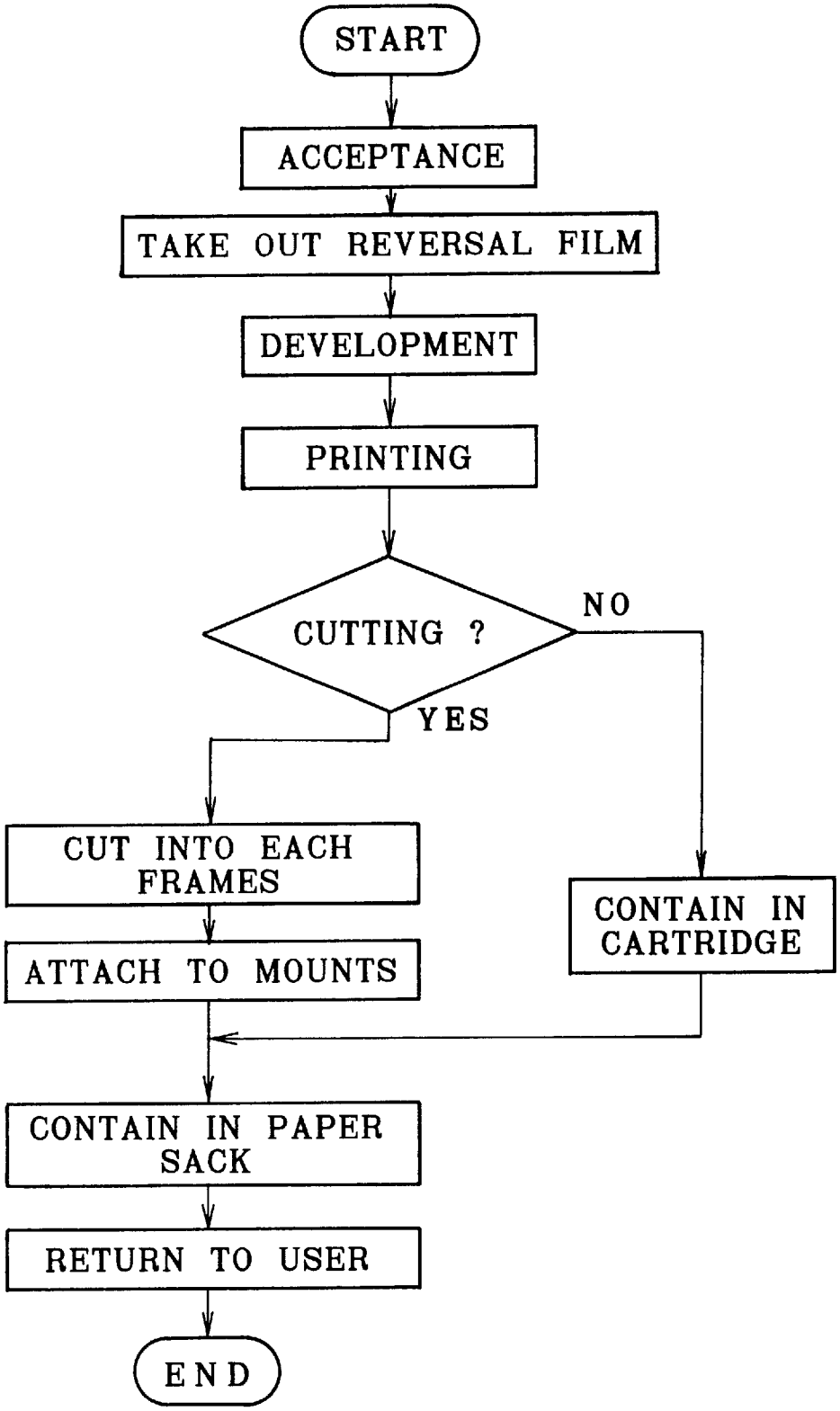
FIG. 7 is a flowchart showing a sequence for changing package form of a reversal film due to a request of a user.

As to a photographic film, there is a reversal film besides the negative film as described above. The present invention may be applied to the reversal film. As shown in FIG. 7, a winding form or one-frame cutting form is selected in accordance with a request of the user. In the one-frame cutting form, the picture frames according to one reversal film are cut one by one and the cut frame is loaded in a mount. The mount is made of paper so that the information magnetically recorded with regard to corresponding frame may be printed on the mount. Alternatively, the reversal film may be cut every six frames, not every one frame, and contained in a sheath.

Figure 8:
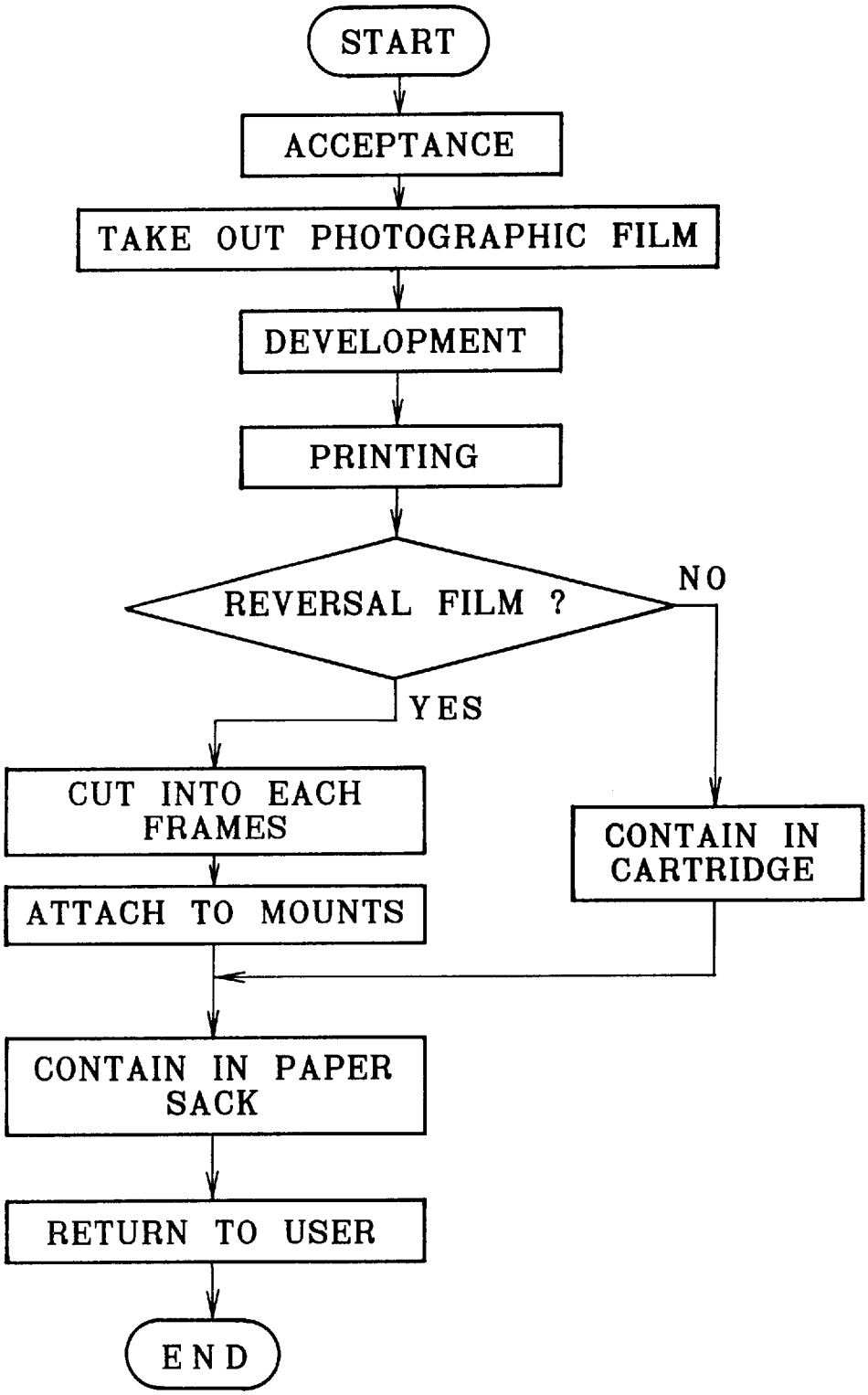
FIG. 8 is a flowchart showing a sequence of another embodiment in which the package form is changed due to whether the reversal film is used or not.

As shown in FIG. 8, the package form may be changed according to whether the exposed photographic film is the negative film or the reversal film. In case of the reversal film, it is cut every one frame and each of cut frame is attached to the mount. In case of the negative film, it is wound in the cartridge as a long film.

A button for selecting the packaging form may be provided on a camera to select one of the winding form and the cutting form. The selecting information inputted with the button is recorded in the magnetic recording layer. When the printing is performed, the selecting information is read out. And the film is returned in a package form desired by the user.

In the embodiment shown in FIG. 2, the film winding unit and the film inserting unit are attached to the printer processor, and cartridge packaging and film sheath packaging are selectively performed. However, the film winding unit and the film inserting unit may be separated from the printer processor. In this case, the photographic film is automatically or manually sorted in accordance with the package form after printing. The photographic film sorted due to the cartridge package form are brought in the film winding unit and the photographic film sorted due to the film sheath package form are brought in the film inserting unit. Further, two systems may be provided. In one of the systems, the film winding unit is attached to the printer processor. In the other of the systems, the film inserting unit is attached to the printer processor. The developed photographic film is sorted according to the package form before printing and sorted photographic film is set to the system corresponding to the package form.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A developing packaging method for a photographic film, comprising the steps of:

drawing a photographic film, on which a plurality of picture frames are formed, out of a cartridge, said cartridge having a function that said photographic film is advanced to outside of said cartridge from a film leader by rotating a spool, said photographic film having a transparent magnetic layer;

developing said photographic film drawn out of said cartridge; and selecting one of a first package form and a second package form, in said first package form, said developed photographic film being cut into a plurality of film pieces and contained in a sheet-like film sheath, and in said second package form, said developed photographic film being wound in said cartridge to be contained as a long film.

2. A developing and packaging method for a photographic film according to claim 1, wherein selecting of said first package form and said second package form is determined due to designation of a user.

3. A developing and packaging method for a photographic film according to claim 1, further comprising the step of:

detecting whether photographic information relative to each of said picture frame is recorded in said magnetic layer, when said photographic information is not recorded, said first package form is selected, and when said photographic information is recorded, said second package form is selected.

4. A developing and packaging method for a photographic film according to claim 1, further comprising the step of:

detecting a mark representing that said photographic film is exposed by a single use camera, when said mark is detected, said first package form is selected, and when said mark is not detected, said second package form is selected.

5. A developing and packaging method for a photographic film according to claim 4, wherein said mark is provided on said photographic film in an optical manner, a magnetic manner or a mechanical manner.

6. A developing and packaging method for a photographic film according to claim 4, wherein said mark is provided on said cartridge in an optical manner or a magnetic manner.

7. A developing and packaging method for a reversal photographic film, comprising the steps of:

drawing a reversal photographic film, on which a plurality of picture frames are formed, out of a cartridge, said cartridge having a function that said reversal photographic film is advanced to outside of said cartridge from a film leader by rotating a spool, said reversal photographic film having a transparent magnetic layer;

developing said reversal photographic film drawn out of said cartridge; and selecting one of a first package form and a second package form, in said first package form, said developed reversal photographic film being cut every each picture frame and attached to mounts, and in said second package form, said developed reversal photographic film being wound in said cartridge to be contained as a long film.

8. A developing and packaging method for a photographic film, comprising the steps of:

drawing a photographic film, on which a plurality of picture frames are formed, out of a cartridge, said cartridge having a function that said photographic film is advanced to outside of said cartridge from a film leader by rotating a spool, said photographic film having a transparent magnetic layer;

developing said photographic film drawn out of said cartridge; and selecting a first package form when said developed photographic film is a reversal photographic film, and selecting a second package form when said developed photographic film is a negative film, in said first package form, said developed reversal photographic film being cut every each picture frame and attached to mounts, and in said second package form, said developed negative film being wound in said cartridge to be contained as a long film.

9. A packaging apparatus for a developed photographic film, in which a photographic film is wound in a cartridge having a function that said photographic film is advanced to outside of said cartridge from a film leader by rotating a spool, said photographic film having a transparent magnetic layer and being developed after drawing out of said cartridge, said packaging apparatus comprising:

a cutter for cutting said developed photographic film;

a film winding unit for containing said developed photographic film into said cartridge;

a film transport changing unit for transporting said developed photographic film to one of said cutter and said film winding unit; and a controller for controlling said film transport changing unit.

10. A packaging apparatus for a developed photographic film according to claim 9, wherein said controller controls said film transport changing unit due to designation of a user.

11. A packaging apparatus for a developed photographic film according to claim 9, wherein said controller controls said film transport changing unit due to photographic information recorded in said magnetic layer.

12. A packaging apparatus for a developed photographic film according to claim 9, wherein said controller controls said film transport changing unit due to whether said photographic film is exposed by a single use camera.

* * * * *